United States Patent [19]

Campbell

[11] 4,005,554

[45] Feb. 1, 1977

[54] BLADE SHARPENING DEVICE FOR ROTATABLE CHOPPING CYLINDERS

[75] Inventor: Steven James Campbell, West Bend, Wis.

[73] Assignee: Gehl Company, West Bend, Wis.

[22] Filed: Aug. 20, 1975

[21] Appl. No.: 606,057

[52] U.S. Cl. ..... 51/249

[51] Int. Cl.[2] ..... B24B 19/00

[58] Field of Search ..... 51/33 HK, 36, 74 BS, 51/247, 249

[56] References Cited

UNITED STATES PATENTS

| | | | |
|---|---|---|---|
| 1,753,406 | 4/1930 | Finn | 51/247 X |
| 3,139,710 | 7/1964 | Ralston | 51/249 |
| 3,354,589 | 11/1967 | Postula et al. | 51/249 |
| 3,683,564 | 8/1972 | Lawrence | 51/249 |
| 3,724,139 | 4/1973 | Leverenz | 51/249 |
| 3,863,403 | 2/1975 | Fleming | 51/249 |

*Primary Examiner*—Al Lawrence Smith
*Assistant Examiner*—James G. Smith
*Attorney, Agent, or Firm*—James E. Nilles

[57] ABSTRACT

A blade sharpening device for a rotatable chopping cylinder for a forage harvester or the like, which cylinder has a plurality of circumferentially spaced and generally parallel blades that are of a generally spiral shape. A carriage moves along parallel to the cylinder and has a sharpening tool extending from it for contact with the blades. Guide means are connected to the carriage and roll along the surface of the blade being sharpened whereby as the carriage moves along the axis of the cylinder a grinding wheel may be maintained in alignment with the blade. Biasing means are provided to maintain a torque on the cylinder and to maintain that blade in contact with the guide means for proper relationship with the grinding wheel.

4 Claims, 8 Drawing Figures

BLADE SHARPENING DEVICE FOR ROTATABLE CHOPPING CYLINDERS

BACKGROUND OF THE INVENTION

This invention relates to apparatus for sharpening the blades of a cylindrical rotor of a forage harvester, or the like, and without the necessity of removing the blades therefrom. The invention is an improvement over prior art sharpeners which are shown, for example, in U.S. Pat. No. 3,724,139, issued Apr. 3, 1973 to Leverenz and U.S. Pat. No. 3,863,403, issued Feb. 4, 1975 to Fleming, both of said patents assigned to an assignee common with the present invention.

SUMMARY OF THE INVENTION

The present invention provides an improved blade sharpening device for a rotatable chopping cylinder of the type having a series of circumferentially spaced, generally parallel and spiral shaped blades. The device includes a carriage which is capable of translational movement supported by a pair of guide rods, said movement being parallel to the axis of the chopping cylinder. The carriage supports a grinding wheel for engagement with one of the blades of the chopping cylinder and facilitates movement of the grinding wheel along the edge of the blade to sharpen the blade. The invention particularly sets forth means for guiding the grinding wheel, the guiding means contacting the same blade being sharpened, thereby guiding the wheel in an exact manner over the blade being sharpened.

The invention also includes means for maintaining a torque on the chopping cylinder and includes means for maintaining each of the blades being ground in spring biased engagement with the grinding wheel used to sharpen the blades.

BRIEF DESCRIPTION OF THE DRAWINGS

FIG. 2*a* is a sectional view taken generally along the line 2*a*—2*a* in FIG. 2, certain parts being shown as broken away or removed for the sake of clarity;

DESCRIPTION OF A PREFERRED EMBODIMENT

Figure 1:
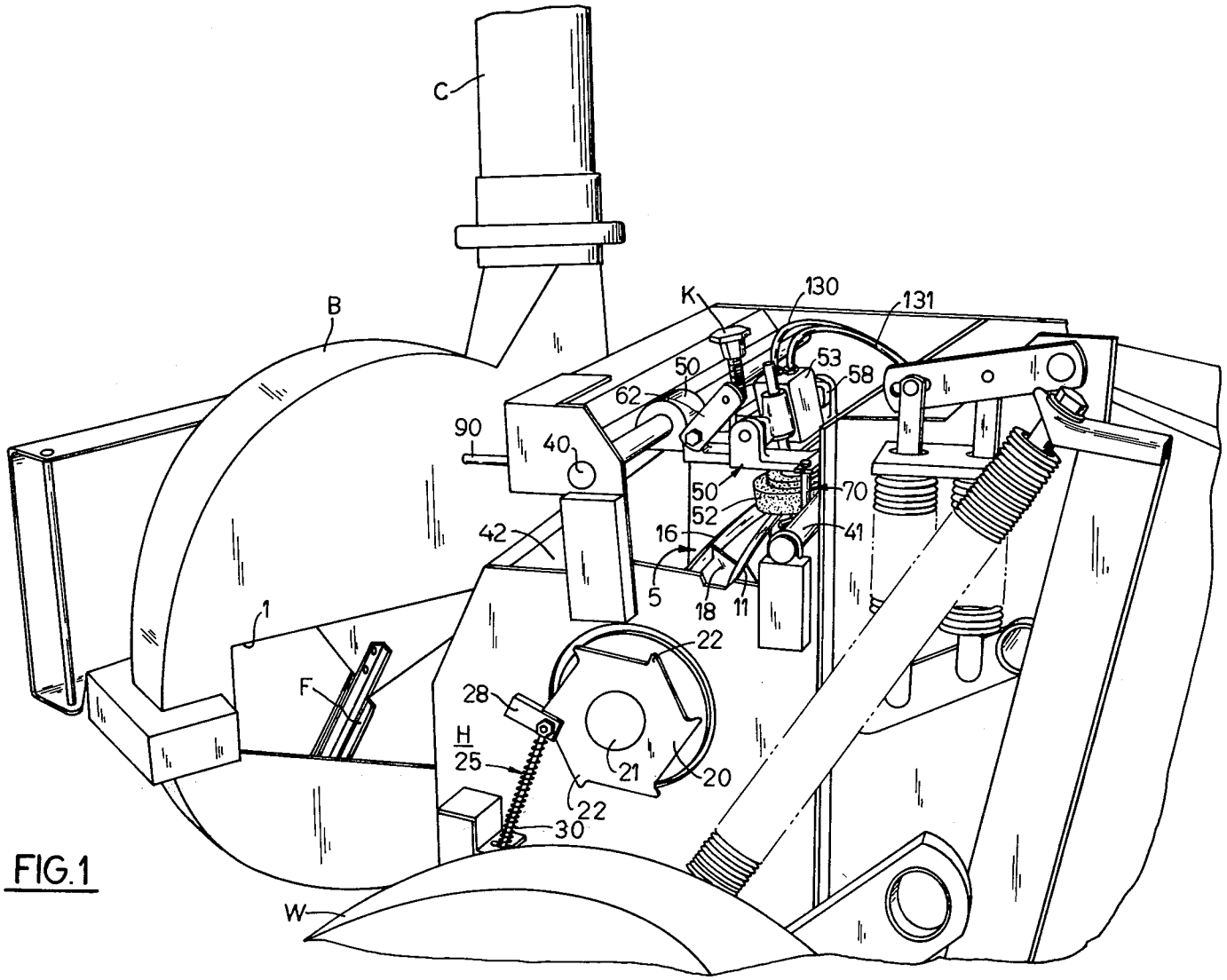
FIG. 1 is a perspective view of a portion of a forage harvester embodying the present invention showing certain parts being swung away from their normal operating position and other parts being shown as broken away or removed for the sake of clarity in the drawings.

The general organization of the invention as applied to a forage harvester is shown in FIG. 1, the forage harvester including a housing H supported on ground engaging means such as the wheel means W and a blower B pivotably attachable to the housing for receiving the cut crop from the housing via the blower opening 1. The blower includes a fan F rotatably mounted therein which delivers the cut crop to the tangentially extending chute C in the known manner. The blower B has been shown for purposes of clarity as being pivotably swung to the rear of the housing, but it will be understood that in operation the blower B will be swung snugly against the housing so that the opening 1 is in immediate adjacency with the housing for receiving cut crops therefrom. Furthermore, when the machine is operating in the field, another cover (not shown) would enclose the top of the chopping cylinder 5, to be described.

Figure 2:
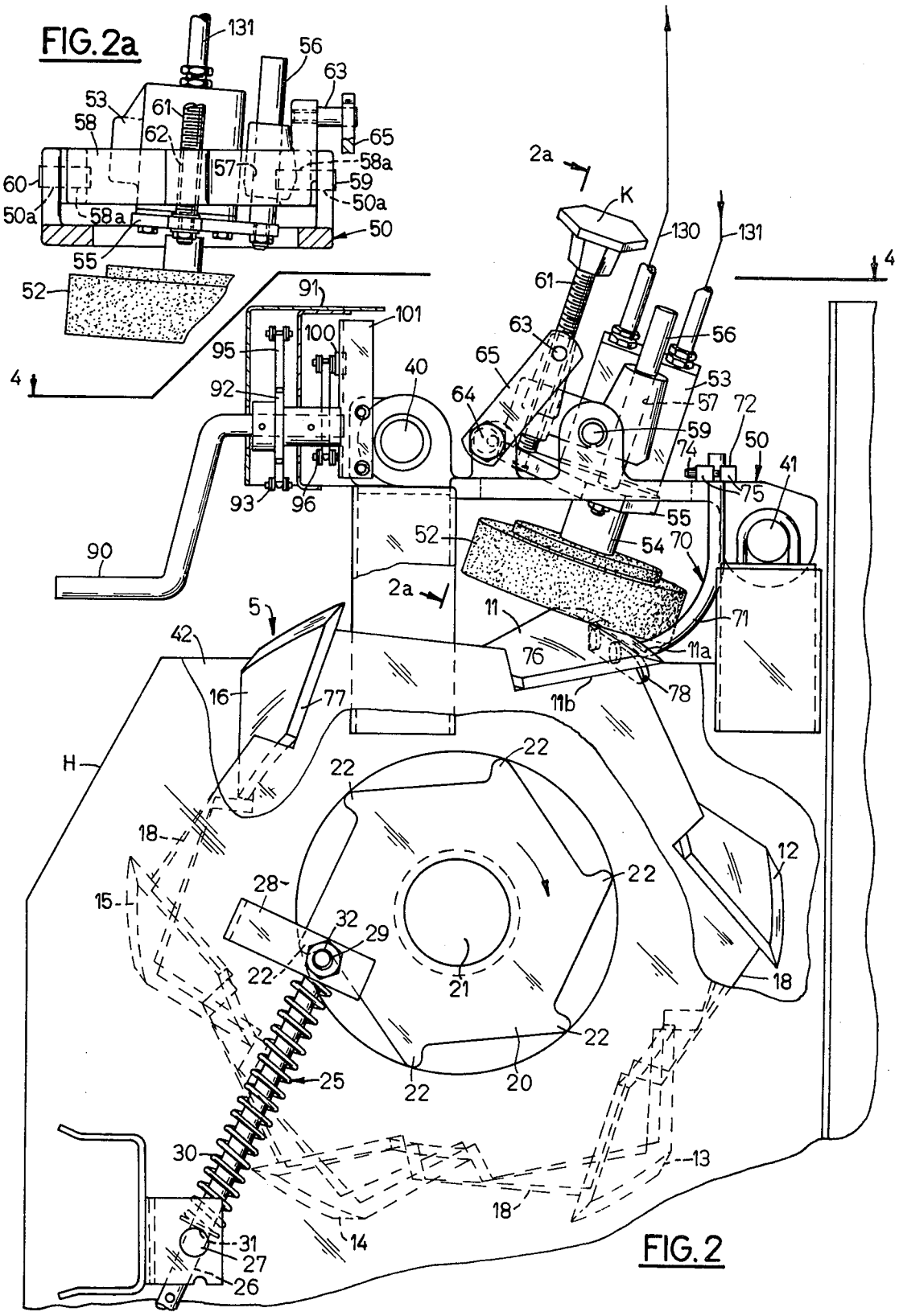
FIG. 2 is an end elevational view of the device shown in FIG. 1, but on an enlarged scale and showing certain parts being broken away or removed for the sake of clarity, and showing the grinder carriage in the position when it commences its sharpening travel at one end of the knife.

As best shown in FIG. 2, a conventional chopping cylinder 5 is rotatably mounted in the housing H for rotation in the direction indicated by the curvilinear arrow. The cylinder has a series, for example six shown, of blades 11, 12, 13, 14, 15 and 16 which are circumferentially spaced and generally parallel to one another, and are mounted on the cylinder rotor frame 18. These conventional blades are arranged to define the periphery of the cylinder and are generally spiral in form. The blades include a front sharpened edge defined by the respective bevelled surface portions, for example 11*a* of the blade 11 which is shown in the position for being sharpened. These edges must be reground periodically to insure sharpness of the blade. The cylinder 5 also includes a plate-like member 20 rigidly fixed to the outer end of the cylinder shaft 21 and located on the outside of the housing H. This plate-like member has a series of projections 22 arranged around its periphery, one for each of the blades. As shown in FIGS. 1 and 2, spring loaded means 25 are provided to act between the housing H and the plate-like member so as to bias the cylinder in the direction of rotation indicated by the curvilinear arrow in FIG. 2. More specifically, the spring loaded means 25 includes an extensible strut 26 which is pivoted at 27 to the housing and which has a clevice 28 fixed by a bolt means 29 to the other end of the extensible strut 26. A spring 30 acts between an anchor 31 on the strut and the extensible end 32 of the strut to thereby urge the bolt means into firm contact with the projections 22 and consequently bias the cylinder in the direction or rotation noted, for a purpose that will hereinafter appear.

Guide track means in the form of parallel rods 40 and 41 are mounted on the housing and are arranged in parallelism with the cylinder axis and adjacent the top opening 42 in the housing. One of said rods is mounted on each side of the opening 42 and extends generally coextensively in length therewith.

A travelling carriage 50 is slideably mounted on and between the guide rods 40 and 41 so that the carriage can be slid from one end of cylinder 5 to the other, more specifically across the full length of the cylinder 5. A sharpening tool in the form of a rotatable grinding wheel is suspended from the carriage 50 such that its flat end surface can be brought into engagement with the bevelled surface of each of the blades to be sharpened. The grinding wheel 52 extends from a hydraulic motor 53 so that the latter can drive the wheel 52 through its drive shaft 54. Generally, the fluid pressure conduits 130 and 131 are provided to extend from the hydraulic motor 53 to a source of fluid pressure, such as a fluid pump carried on the propelling vehicle (not shown).

The grinding wheel 52 and the associated hydraulic motor 53 are adjustable as a unit relative to that blade of the cylinder to be sharpened, as follows. The hydraulic motor 53 is rigidly carried on the carriage 50 by a motor mounting plate 55 which has a generally vertically extending torque arm 56 rigidly fixed thereto. The torque arm is slideably mounted in aperture 57 formed in a motor support 58.

The motor support 58 is pivotally mounted on the carriage 50 by means of two stub shafts 59 and 60 which extend through aligned holes 58*a* and 50*a* of the support 58 and carriage 50, respectively.

A threaded member 61 is rotatably mounted at one end in mounting plate 55 and is then in threadable engagement with a threaded bore 62 in the support 58. A hand adjusting knob K is fixed at the end of threaded member 61.

A link 65 is connected by pin 63 to the support 58 and by an eccentrically movable nut 64 to the carriage 50.

The above construction permits the arm 58, motor 53 and wheel 52 to be adjustable in a generally perpendicular direction relative to the blade to be sharpened, and this is accomplished by rotating the knob K in one direction or the other. Adjustment of the eccentric nut 64 varies the angle of the motor 53 and its grinding wheel 52 relative to the blade to insure that the proper angle is ground on the bevel edge 11*a*.

Figure 3:
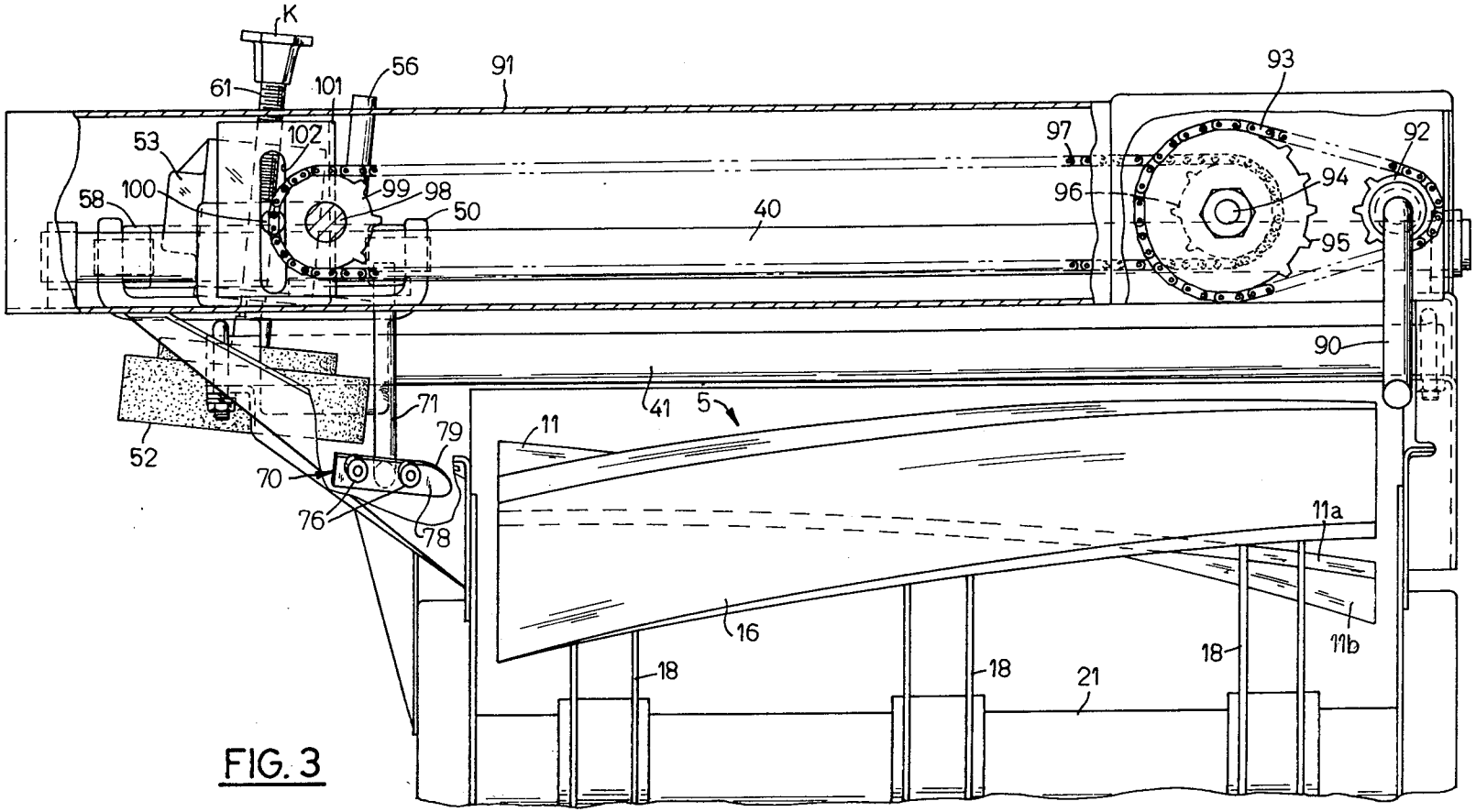
FIG. 3 is a view taken generally along the line 3—3 in FIG. 4, certain parts being shown as broken away for the sake of clarity, and showing the carriage at one extreme end of its travel, before contact with a knife to be sharpened.
Figure 4:
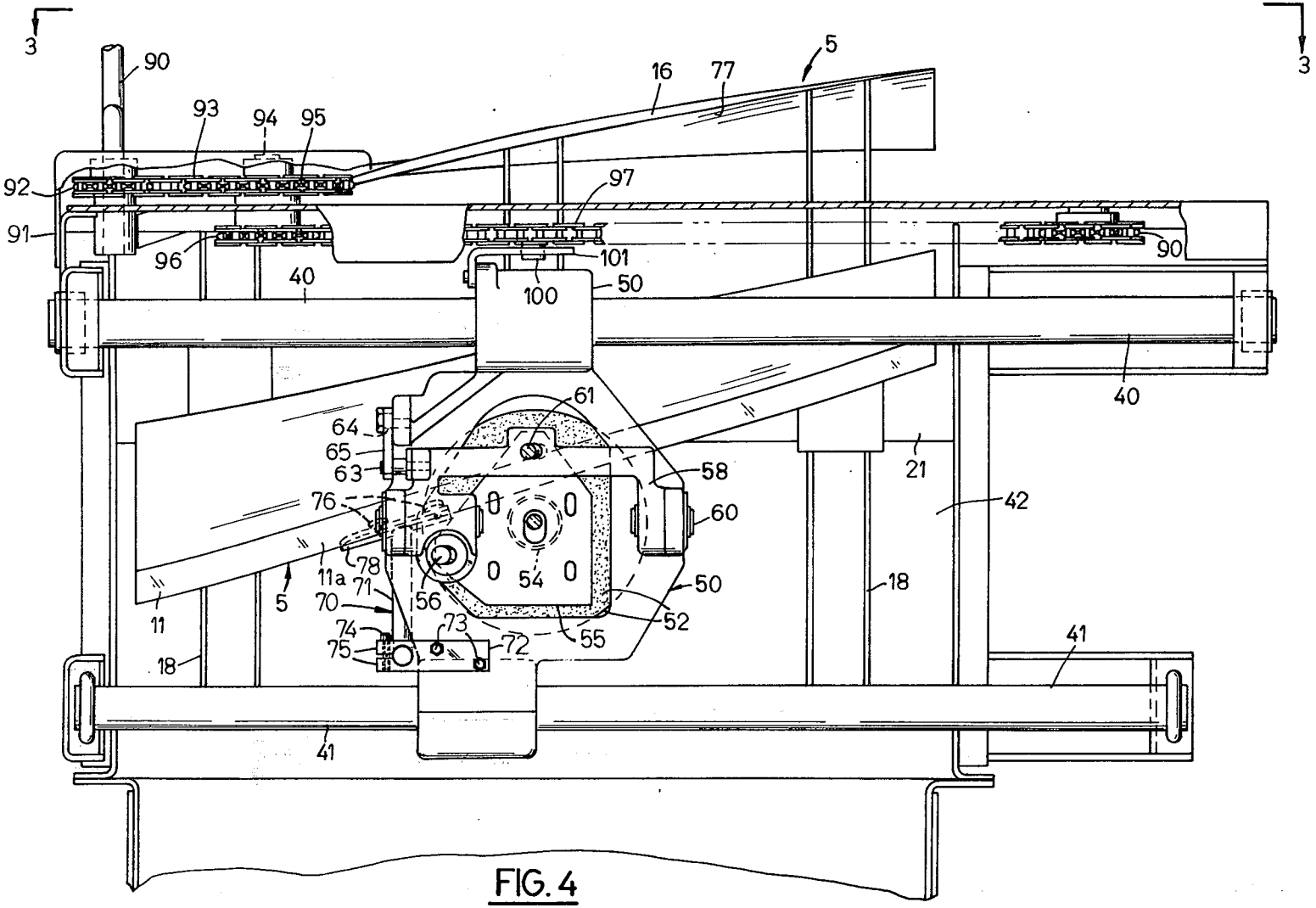
FIG. 4 is a sectional, plan view taken generally along the line 4—4 in FIG. 2, but showing the carriage when about half-way through a sharpening passover the knife, certain parts being shown as broken away or removed for the sake of clarity.
Figure 5:
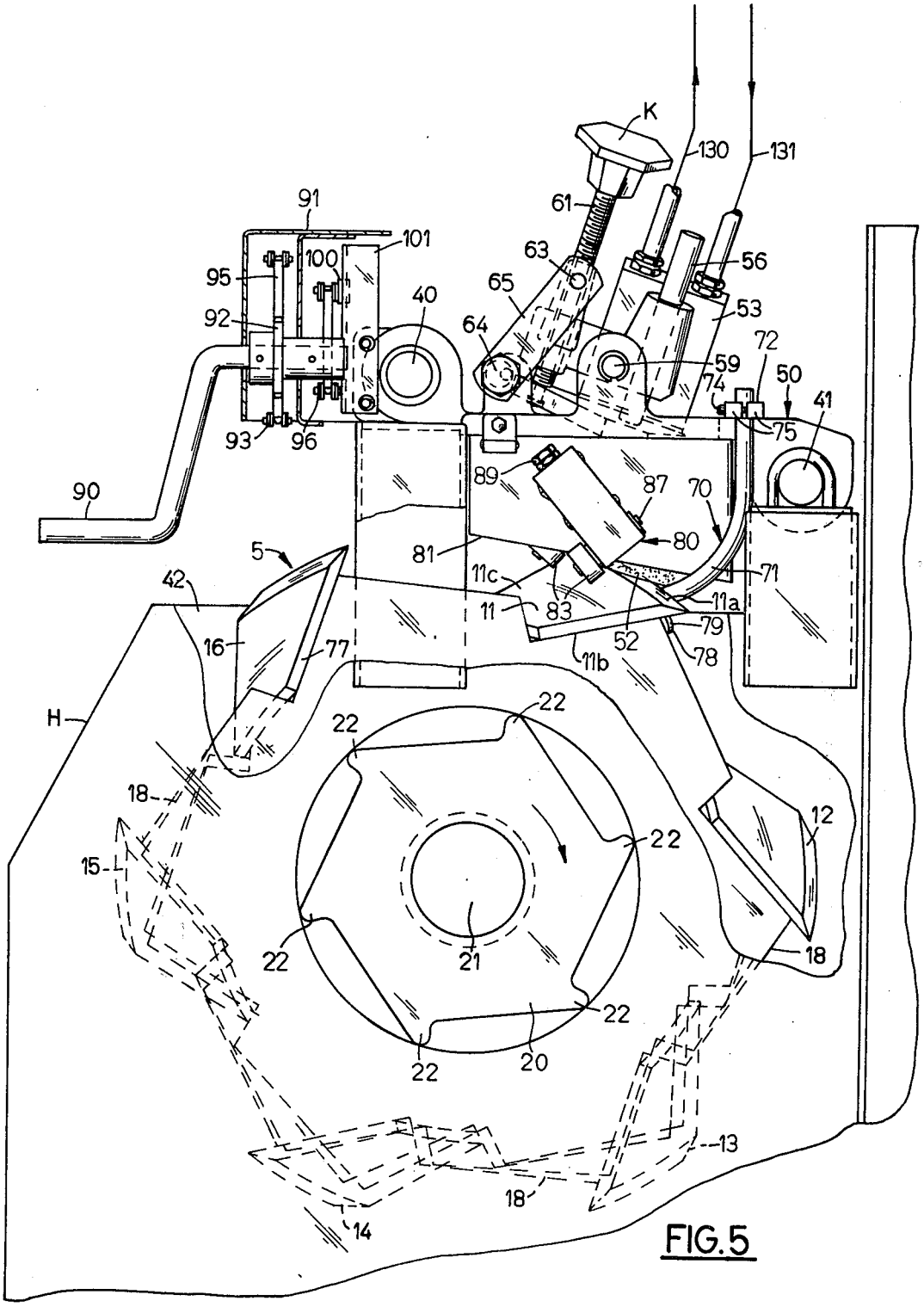
FIG. 5 is a view similar to FIG. 2 but showing a second embodiment of the invention.
Figure 7:
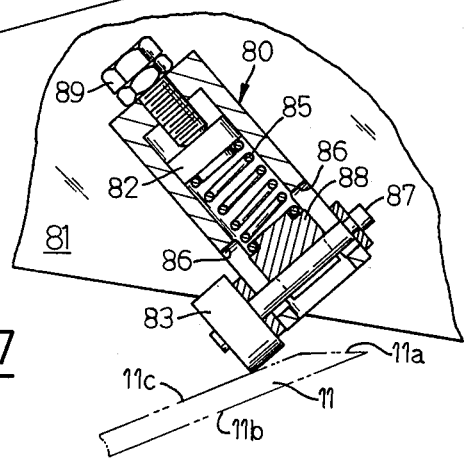
FIG. 7 is a cross-sectional view of a roller assembly of the second embodiment.

Though not shown in FIGS. 1–4 in the interests of clarity, it may be desirable to provide a protective box attached to the carriage 50 and surrounding the grinding wheel as shown in FIGS. 5 and 7 by box 81.

As best shown in FIGS. 2 and 4, the carriage 50 also includes a guide means assembly 70, secured thereto and provided to insure correct positioning of each of the cutting blades while they are being sharpened by the grinding wheel 52. Since the cutting blades, such as blade 11 have a helically curved surface it is necessary to rotate the cylinder 5 somewhat to maintain the grinding wheel in engagement with the cutting edge 11*a* of the blade as the grinding wheel traverses the length of the blade. As previously stated, the cylinder 5 is biased in a clockwise direction as shown in FIG. 2 by the spring loaded strut means 25 acting on the plate 20 and is properly aligned with the grinding wheel 52 by the guide means assembly 70 which permits the proper amount of rotation of the cylinder 5 as the carriage 50 and grinding wheel 52 are moved axially along the cutting blade as the blade is being sharpened so that a proper edge is formed. The guide means 70 includes a curved arm 71 which is fastened by a clamping bracket 72 to the carriage 50. The clamping bracket 72 is secured to the carriage 50 by the bolts 73 and includes a bolt 74 which can be tightened to permit the arm 71 to be clamped between the fingers 75. As best shown in FIGS. 2 and 3, the curved arm 71 includes a pair of rollers 76 at its end which are received on the radially inner side of the blade, for example side 11b of blade 11, and which are adapted to roll along the blade as the carriage 50 traverses the length of the cylinder 5.

The guide means 70 also includes a ramp plate 78 mounted on the end of the arm and supporting the rollers 76. The ramp plate 78 has a curved leading edge 79 so that, when the carriage 50 is at the extreme end of blade 11, the edge 79 will orient the guide means and rollers 76 with respect to the blade 11.

FIGS. 3 and 4 illustrate a manually operated drive means which is provided for driving the carriage 50 along the length of the guide track means 40, 41 in either direction to facilitate grinding of the entire length of the cutting blades. This drive means includes a crank 90 which can be continuously rotated by the operator so as to reciprocate the carriage along the guide track means. More specifically, the crank has a relatively small sprocket 92 fixed thereto and over which the endless chain 93 is trained. A shaft 94 is fixed within a housing 91 and has a pair of sprockets 95 while another endless flexible member in the form of a roller chain 97 is trained around sprocket 96. Another shaft 98 is also mounted in the housing 91 and has a sprocket 99 mounted thereon and over which the chain 97 is also trained.

A drive chain pin 100 (FIGS. 2 and 4) is carried by the chain 97 and extends from the side thereof, a plate member 101 is fixed to the carriage and has a vertical slot 102 formed therein for the reception of the chain pin 100. Thus, the pin 100 travels in an orbital path with the chain 97 when the operator turns the crank 90. The pin 100 consequently carries the carriage with it via the connecting slotted plate 101. At either end of travel of the carriage, the pin moves vertically in the slot 102 and continued rotation of the crank 90 then causes the pin to reverse its travel, carrying with it the carriage. As a result, continuous rotational motion of the crank 90 by the operator in one direction is translated into reciprocating motion of the carriage. Thus the grinding wheel 52 can be caused to make various passes, in either direction, over the blade being sharpened.

Figure 6:
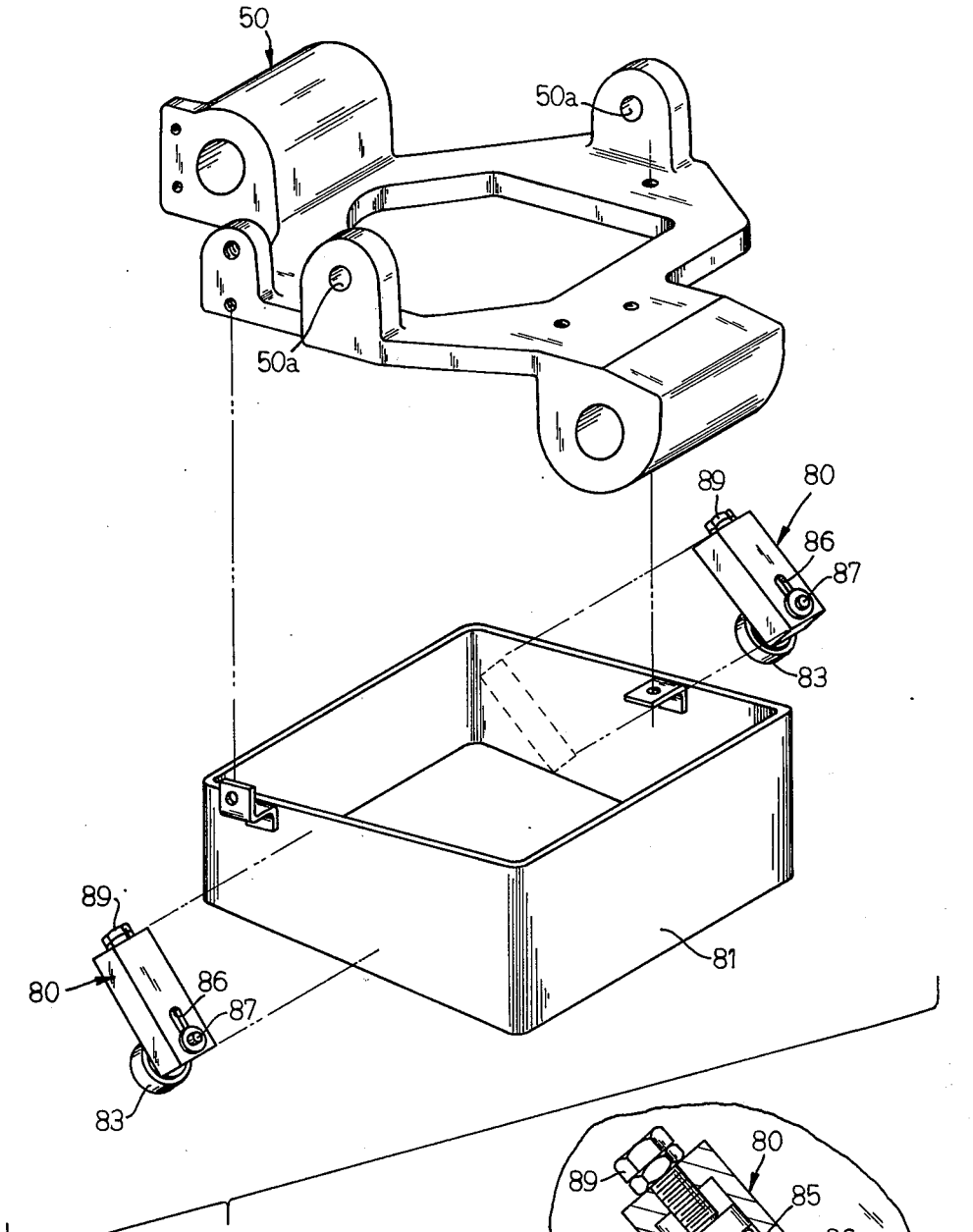
FIG. 6 is an exploded view of a portion of the second embodiment.

As previously mentioned, it is necessary to provide means for biasing the cylinder in the direction of rotation indicated in FIG. 2 by the curvilinear arrow so that the blade 11 is held snugly against the rollers 76 of the guide means as the sharpening tool 52 moves axially along the cylinder, and to cause the cylinder to rotate sufficiently, because of the spiral nature of the blade shape, to insure that the wheel 52 is presented at the proper attitude to the blade along its entire length. FIGS. 5–7 illustrate an alternative embodiment of the means for biasing the cylinder in the direction of rotation during grinding of the blades. The structural elements of the embodiment shown in FIGS. 5–7 which are the same as those illustrated in the first embodiment are indicated by the same numbers.

As shown in FIGS. 5 and 6, the carriage 50 is provided with a protective box 81 extending downwardly from the carriage to surround the grinding wheel 52. The protective box 81 functions to preclude the possibility of injury to the operator during the sharpening of the blades if, for example, the wheel 52 should fly apart. A pair of roller assemblies 80 are secured to opposite sides of the box 81 surrounding the grinding wheel and each includes a roller 83 which is spring biased into engagement with the radially outer surface 11c of blade 11. The rollers 83 each apply a force on the blade 11 forcing it against the guide means 70 and as the carriage 50 traverses the length of the blade, the rollers will cause the cylinder 5 to rotate such that the cutting blade is maintained in engagement with the guide means 70. The roller assemblies 80 and the guide means 70 thus receive the blade 11 to be sharpened in secured relation therebetween and maintain the surface 11a in contact with grinding wheel 52 as the grinding wheel traverses the length of the blade. Since the roller assemblies are mounted on opposite sides of the grinding wheel 52 and in alignment with its direction of movement, even if the grinding wheel is positioned at the ends of the cylinder, at least one of the rollers will contact the blade.

As shown in FIG. 7 the rollers 83 are supported in the roller assemblies 80 on shafts 87 which are transversely slideable in slots 86. The shafts are spring biased downwardly by springs 85 which are restrained between a disc 82 and a plug 88. The amount of tension in the spring and downward force exerted by the rollers 83 on the cutting blade can be adjusted by an adjustable screw 89.

RESUME

The blade sharpening apparatus of the present invention is particularly advantageous in that it includes means for guiding the grinding wheel from the same blade which is being ground thereby avoiding inaccuracies in the grinding of the blades due to discrepancies in shape of the various blades spaced around the cutting cylinder. The guide means is also advantageous in that it avoids expense during manufacture because it provides simplified and uncomplicated means for biasing the cutting blades against the grinding wheel and the guide means.

I claim:

1. A blade sharpening device for use with a forage harvester having a housing and a cutting cylinder rotatable about an axis and retained within the housing and having a plurality of circumferentially spaced spiral shaped cutting blades to be sharpened, said blades each having a radially inner surface, a radially outer surface, and a bevelled cutting surface, said sharpening device comprising guide track means supported on said housing, a carriage movably supported on said guide track means for movement generally parallel to said cylinder axis, a grinding wheel supported on the carriage and including a flat side selectively engageable with the bevelled cutting surface of one of said cutting blades to be sharpened, and guide means including an arm secured to said carriage and extending therefrom, said guide means also including guide rollers supported on said arm and engageable with the inwardly facing surface of said one cutting blade adjacent and opposite said bevelled cutting surface for guiding said grinding wheel along said bevelled cutting surface, and means biasing said cutting blade into said guide rollers to position said knives for grinding engagement with said wheel.

2. The device set forth in claim 1 wherein said biasing means is a spring biased strut secured at one end to said forage harvester housing and abutting said cutting cylinder at the other end whereby said spring strut exerts torque on said cylinder to bias said cutting blade into said guide rollers to position said knives for grinding engagement with said grinding wheel.

3. The device set forth in claim 1 wherein said biasing means comprises spring loaded rollers extending from said carriage and supported thereby, said rollers abutting the outer surface of said blade being sharpened whereby said cutting blade is biased against said guide rollers and to position said knives for grinding engagement with said grinding wheel.

4. A blade sharpening device for use with a forage harvester having a housing and a cutting cylinder rotatable about an axis and retained within the housing and having a plurality of circumferentially spaced spiral shaped cutting blades to be sharpened, said blades having outer surfaces defining the periphery of said cylinder, and said blades each having a radially inner surface and a bevelled cutting surface, said sharpening device comprising guide track means supported on said housing, a carriage movably supported on said guide track means for movement generally parallel to said cylinder axis, a grinding wheel supported on the carriage and including a flat side selectively engageable with the bevelled cutting surface of one of said cutting blades to be sharpened, guide means including an arm secured to said carriage and extending therefrom and including guide rollers supported on said arm and engageable with the inner surface of said one cutting blade adjacent and opposite said bevelled cutting surface for guiding said grinding wheel along said bevelled cutting surface, and means biasing said cutting blade into said guide rollers to position said knives for grinding engagement with said wheel; said biasing means including spring biased rollers extending from said carriage and supported thereby, said rollers abutting said outer surface of said blade being sharpened whereby said cutting blade is biased against said guide rollers to position said knives for grinding engagement with said grinding wheel, said spring biased rollers being mounted on opposite sides of said grinding wheel and in alignment with the direction of movement of said grinding wheel along said track means, whereby at least one of said spring biased rollers will contact said blade when said grinding wheel is in grinding engagement with said blade.

* * * * *